US006312117B1

(12) United States Patent
Gaasch

(10) Patent No.: US 6,312,117 B1
(45) Date of Patent: Nov. 6, 2001

(54) INK JET PRINTER PEN WITH EXTRA FLUID DISPENSER

(75) Inventor: Todd M. Gaasch, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/148,035

(22) Filed: Sep. 3, 1998

(51) Int. Cl.[7] ..... B41J 2/175
(52) U.S. Cl. ..... 347/86
(58) Field of Search ..... 347/28, 21, 29, 347/31, 33, 43, 86, 87

(56) References Cited

U.S. PATENT DOCUMENTS

| | | | | |
|---|---|---|---|---|
| 5,027,134 | | 6/1991 | Harmon et al. | 347/29 |
| 5,103,244 | | 4/1992 | Gast et al. | 347/33 |
| 5,115,250 | | 5/1992 | Harmon et al. | 347/33 |
| 5,300,958 | * | 4/1994 | Burke et al. | 347/28 |
| 5,517,221 | | 5/1996 | Nguyen | 347/31 |
| 5,589,861 | | 12/1996 | Shibata | 347/22 |
| 5,624,484 | | 4/1997 | Takahashi et al. | 106/31.75 |
| 5,635,965 | | 6/1997 | Purwins et al. | 347/31 |
| 5,706,038 | | 1/1998 | Jackson et al. | 347/33 |
| 5,719,603 | | 2/1998 | Nguyen | 347/31 |
| 5,754,197 | | 5/1998 | Shibata | 347/22 |
| 6,126,268 | * | 10/2000 | Askeland et al. | 347/43 |

* cited by examiner

*Primary Examiner*—Anh T. N. Vo

(57) ABSTRACT

An ink jet print cartridge having a first ink chamber containing a first type of ink and a second ink chamber containing a second type of ink. The body has a third fluid chamber containing an unpigmented fluid different from the inks. A printhead attached to the body has a set of orifices associated with each chamber. The inks may be reactive inks, and the third fluid a buffer to prevent precipitation reaction on the print head surface. The orifices for the buffer may be positioned between the orifices for the different inks to prevent mixing during wiping, except in the presence of the buffer.

4 Claims, 4 Drawing Sheets

FIG. 1
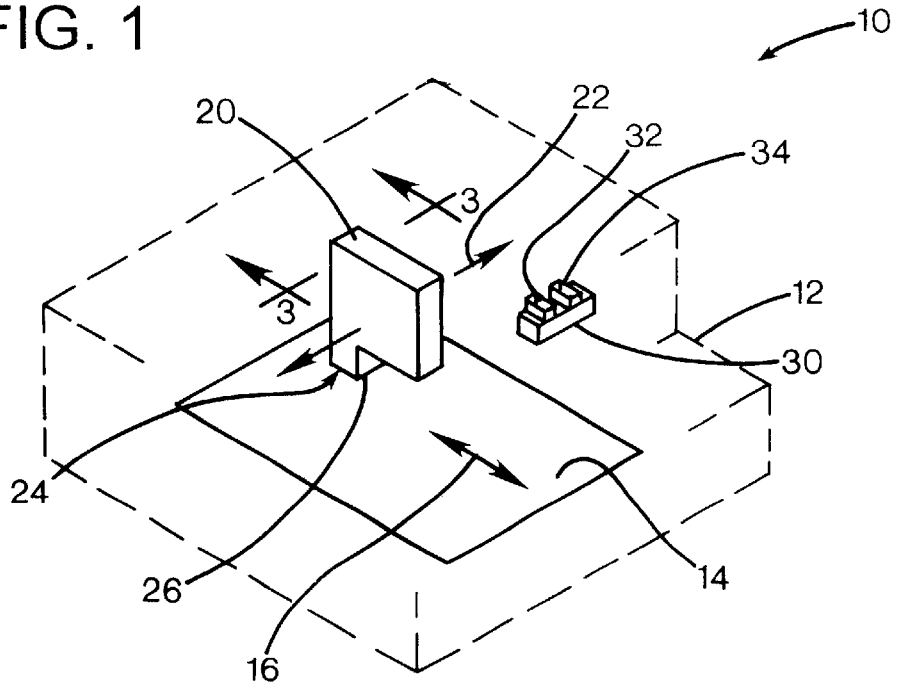
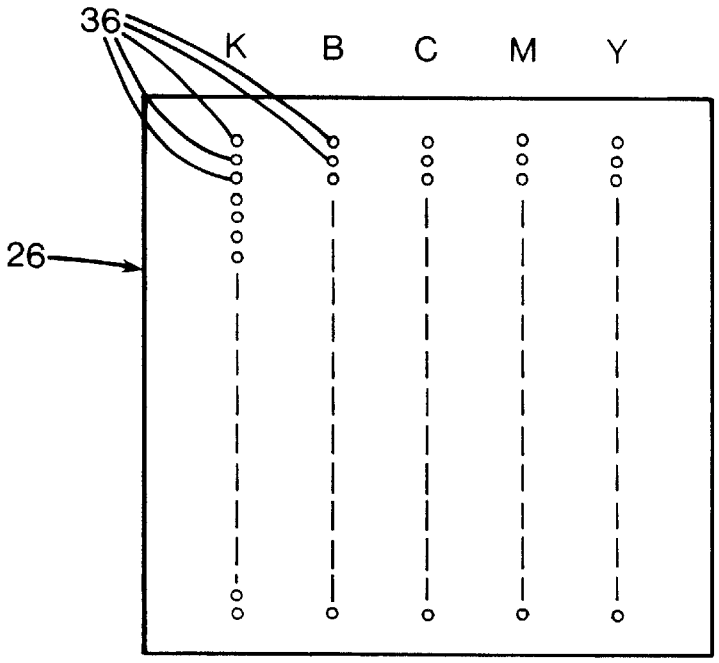
FIG. 2

INK JET PRINTER PEN WITH EXTRA FLUID DISPENSER

FIELD OF INVENTION

This invention relates to ink jet printing, and more particularly to ink jet cartridges having multiple ink colors.

BACKGROUND AND SUMMARY OF THE INVENTION

In ink jet printers, ink jet print cartridges or pens are reciprocated on a carriage to print swaths on an advancing media sheet. Pens typically include an ink chamber partially filled with ink, with a print head having an array of nozzles for expelling ink droplets in a controlled pattern. For color printing, existing pens typically use three different color inks to provide a range of colors when printed in different proportions. In addition, many printers use separate black ink cartridges.

During normal printer operations, it is necessary to wipe the surface of the print head. This may occur before printing begins, at intervals during printing, and after printing concludes. Wiping serves to remove any debris, and to "prime" any dry nozzles by the capillary or wicking effect of a flexible wiper passing over each nozzle while carrying ink drawn from other nozzles.

Typically, the ink chemistry for color ink is different from that of black inks. Color inks require controlled interaction to provide color mixing or blending, and edge acuity is only moderately important. Black inks, on the other hand, require good edge acuity for printing detail-critical images and text. In addition, for printing a combination of color and black inks, such as on a page including black text and color photographs, the chemical interaction between the different ink types is important.

For critical applications, black inks are selected to be chemically reactive with the color inks, so that a precipitation reaction occurs when black and color ink droplets meet on a media sheet. Instead of blurring, blending, and compromising edge acuity, the black pigment precipitates out of solution at the location where it was initially directed. Typical reactive ink sets have inks of different pH values, where a black ink may be acidic while the color inks are basic. However, the use of reactive inks will lead to a reaction wherever they mix. Accordingly, printers using such inks employ separate pens for each ink type, each with its own print head. This allows wiping of the print heads without mixing of different ink types that would react to generate an increasing quantity of precipitate sludge, which may resist wiping, and which may cause nozzle clogging and other performance and reliability problems.

In less critical applications, low cost printers use non reactive black and color inks in a single pen, where the color and black ink chemistry is the same, or adequately compatible to prevent precipitation during wiping. The use of a single pen eliminates the need for alignment procedures between pens, reduces costs by eliminating many electrical interface connections and mechanical pen-retaining latches, and reduces the number of electrical connections. However, the use of non reactive ink compromises the edge acuity where black ink interacts with color ink, so there is a trade off between cost and performance.

The present invention overcomes the limitations of the prior art by providing an ink jet print cartridge having a first ink chamber containing a first type of ink and a second ink chamber containing a second type of ink. The body has a third fluid chamber containing an unpigmented fluid different from the inks. A printhead attached to the body has a set of orifices associated with each chamber. The inks may be reactive inks, and the third fluid a buffer to prevent precipitation reaction on the print head surface. The orifices for the buffer may be positioned between the orifices for the different inks to prevent mixing during wiping, except in the presence of the buffer.

BRIEF DESCRIPTION OF THE DRAWINGS

FIG. 1 is an simplified perspective view of an ink jet printer pen according to a preferred embodiment of the invention.

FIG. 2 is a plan view of an ink jet print head according to the embodiment of FIG. 1.

DETAILED DESCRIPTION OF A PREFERRED EMBODIMENT

Figure 3:
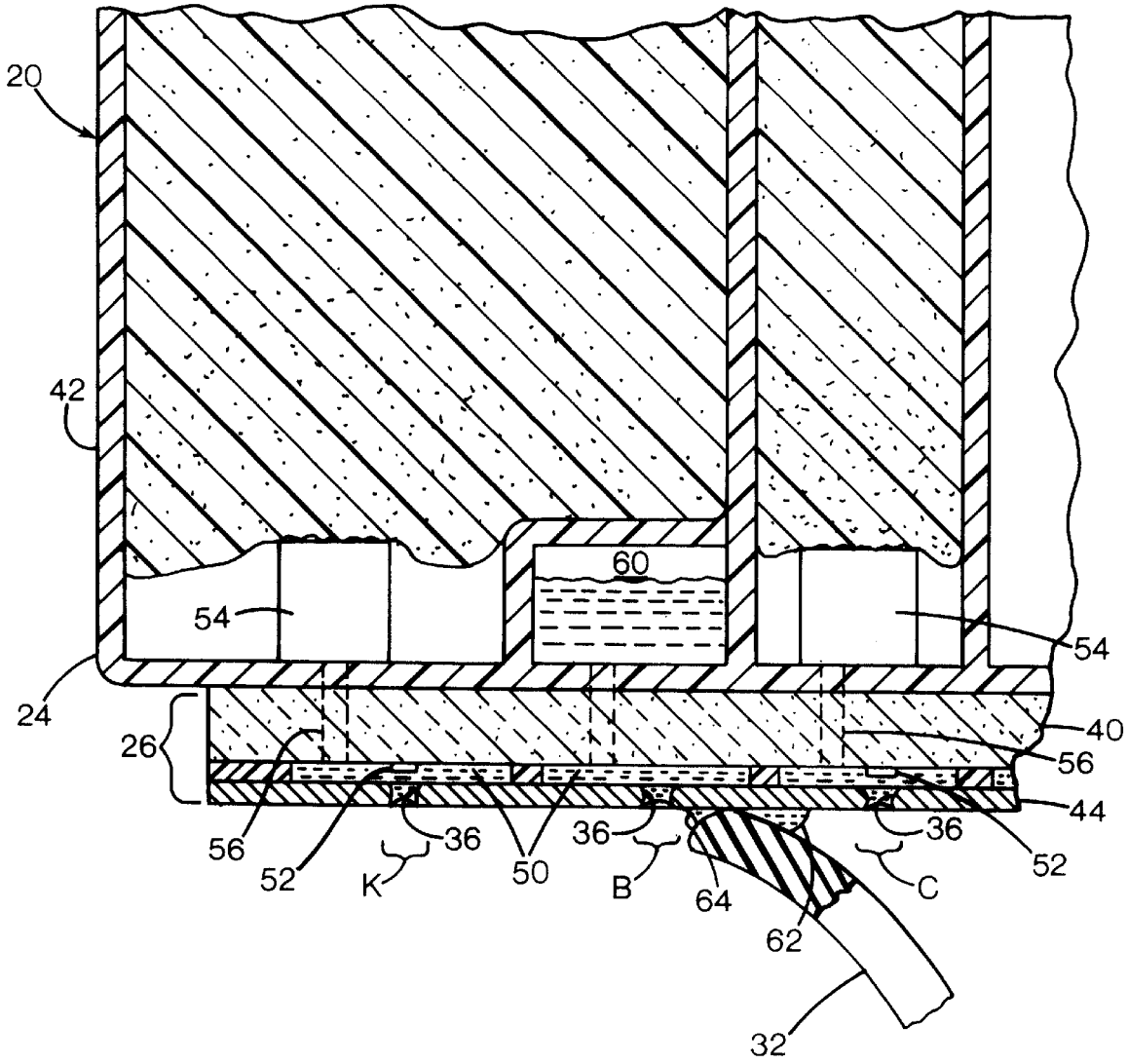
FIG. 3 is an enlarged sectional view of a ink jet pen taken along line 3—3 of FIG. 1.

FIG. 1 shows an ink jet printer 10 having a housing 12 defining a paper path for receiving and advancing a media sheet 14 along a feed axis 16. A single ink jet pen or cartridge 20 reciprocates along a scan axis 22 perpendicular to the feed axis 16, so that the pen reciprocates over the sheet. The pen is removably mounted to a carriage (not shown) that is driven along a rail (not shown) parallel to the scan axis. The pen has a downwardly facing nose portion 24 to which is mounted a print head 26, as will be discussed in greater detail below.

A pen service station 30 is connected to the housing adjacent the paper path, and at the end of the path followed by the reciprocating pen. A flexible elastomeric wiper blade 32 extends upward to a height that interferes with the path of the nose of the pen. Thus, the blade is flexed and biased against the print head when the pen passes by, wiping the print head surface of debris, and spreading a film of ink across the print head surface to fill any empty or dry nozzles so that they are "primed" for subsequent printing. The service station also includes a pen cap 34 that covers the print head when the pen is idle, and into which the pen may be operated to "spit" or expel droplets of ink to ensure that the pen is operating properly before printing begins.

As shown in FIG. 2, the print head 26 is a rectangular element defining several columns of orifices or nozzles 36. Each column is labeled for the fluid that is retained in a reservoir that exclusively communicates with that column. Column K provides black ink; column B provides an unpigmented chemical buffer; column C provides cyan ink; column M provides magenta ink; and column Y provides yellow ink. In the preferred embodiment, the buffer column separates the black column from the color ink columns, as shown. In alternative embodiments, the columns may be of different length, different spacing, and the nozzles of different sizes.

The black ink has a different chemistry from any of the color inks, which are similar chemistry to each other except for their pigmentation or dye differences. The black ink is chemically reactive with respect to any of the color inks in the absence of the buffer to generate a black or colored solid precipitate, which during normal printing adheres to the media sheet where black and color inks overlap or abut to provide a sharply defined image. In the preferred embodiment, the black ink has a different pH from the color inks; one type may be acidic and the other basic. The inks may also differ in that one type may contain a pigment, and the other type may contain a dye.

The buffer is selected to be chemically compatible with, or reactive to, one or the other of the black or color ink types, or both, to prevent the reaction that normally and desirably occurs on the media sheet, or to provide an alternative desirable reaction. The buffer may be a salt associated with the acid in one of the inks, so that it neutralizes the ink before it contacts and reacts with the other type ink on the print head surface. Alternatively, the buffer may be selected to provide a physical barrier to intermixing of inks, such as by providing a non-wettable surface. In other embodiments where intermixing on the print head is not a concern, the buffer nozzles may instead provide another beneficial fluid other than ink, such as a solvent or cleaning fluid for aiding wiping of dried ink, or a lubricant for reducing wiping friction or for permitting wipes with particularly high normal force.

FIG. 3 shows the pen 20 in greater detail, with the print head 26 as attached. The print head includes a semiconductor chip 40 mounted to the nose 24 of the pen housing 42. An orifice plate 44 is connected to the chip by way of a barrier layer 46, which defines ink manifold regions 50 below each column of nozzles. The manifolds provide fluid to the nozzles and the barrier separates adjacent manifolds to prevent ink mixing. The chip includes a plurality of firing resistors 52 on the chip surface, each aligned with a single nozzle in each of the ink columns. No resistors are provided in the buffer column, as buffer (or alternative mixing preventative or wiping facilitating) fluid does not need to be ejected from the print head.

For each column or nozzles 36, a fluid supply is provided. For each ink nozzle column, a respective foam-filled pen chamber (K, C shown) communicates via a screened standpipe 54 and a passage 56 between the standpipe and the manifold 50. Each ink chamber has a volume occupying a substantial fraction of the entire pen, with all four ink chambers occupying substantially the entire pen volume. A much smaller auxiliary fluid chamber 60 is provided adjacent the print head for the buffer or other selected non-printing fluid. The chamber 60 communicates with the manifold 50 associated with nozzle column B. Although not shown, each of the fluid chambers has a controlled vacuum relief valve or other pressure control element to allow fluid to be depleted from the chamber without the excessive build up of a negative pressure head.

As shown, the wiper blade 32 flexes as the pen passes by, with FIG. 3 showing leftward movement of the pen relative to the wiper. In this process, the wiper collects liquid from the surface and wicks liquid from the nozzles to form a frontal liquid bead 62 and a trailing bead 64. Both the frontal bead and the trailing bead comprise a mixture of the fluids from the nozzles over which the wiper has passed, as will be discussed in detail below.

Figure 4A:
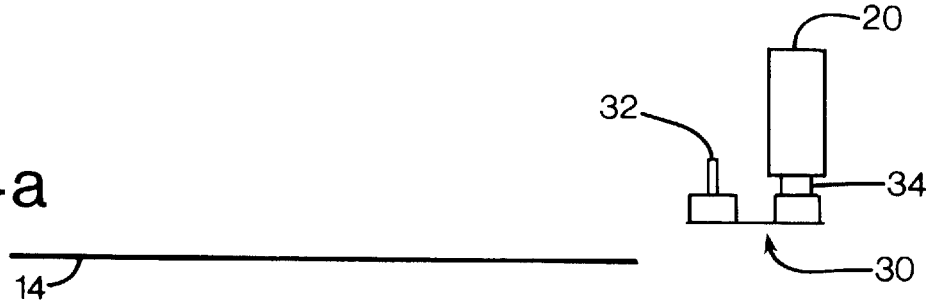
FIGS. 4*a*–4*d* are simplified schematic views of a sequence of operation of the printer of FIG. 1.
Figure 4B:
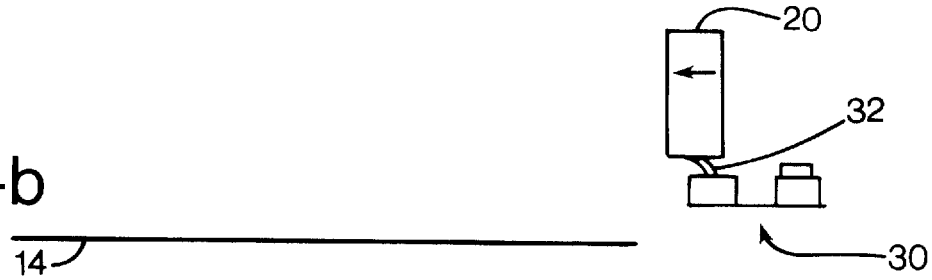
Figure 4C:
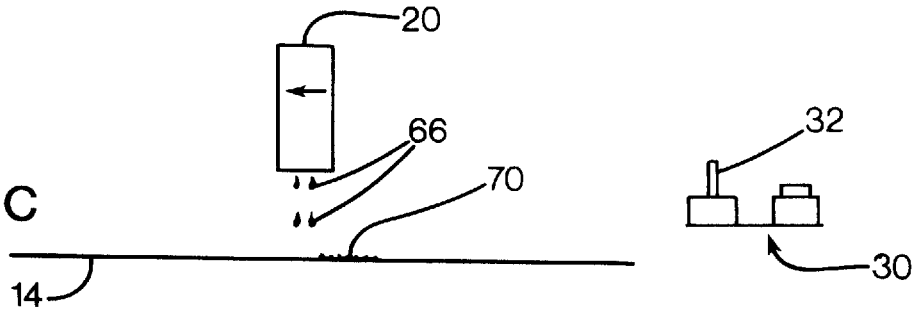
Figure 4D:
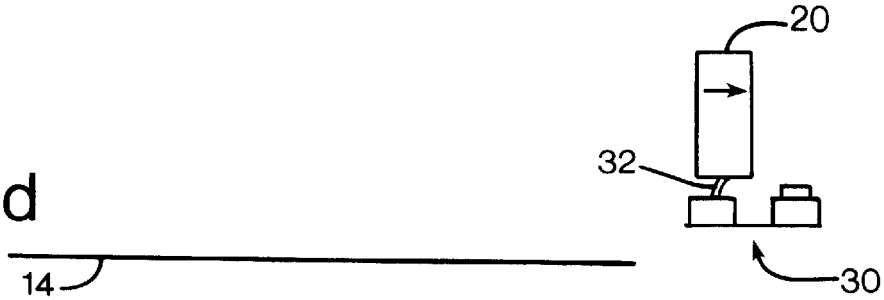

Pen servicing and printer operation proceeds as illustrated in FIGS. 4*a*–4*d*. In FIG. 4*a,* the pen 20 is positioned at the service station 30, laterally adjacent to the media sheet 14. This is the idle state of the printer between print jobs. The print head is sealed against contamination and evaporation by the cap 34. In FIG. 4*b,* printing is to be initiated, and the pen is shifting to the left, so that the surface of the print head is wiped by the wiper. Following this, although not shown, the pen may be operated to spit ink from each of the ink nozzles, to eliminate any ink and buffer mixture retained in each orifice near the outlet. Printing proceeds as shown in FIG. 4*c,* with the pen ejecting droplets 66 of ink onto the sheet 14. At least some of the printed portions 70 of the sheet include black and color ink droplets overlapping or abutting each other, such as where black text is printed on a colored field. As shown in FIG. 4*d,* the pen 20 is being wiped after completion of a print job, or as a maintenance break during a major print job.

This post-printing wipe serves to wipe wet or dried microscopic aerosol droplets that are ejected along with the ink droplets during normal printing, and some of which alight on the print head surface. By including the buffer fluid drawn from the buffer orifices along with ink drawn from the ink orifices during wiping, adequate solvent to clean the particles of dried ink is provided. It is important prior to returning to an idle state for an extended period to avoid allowing reactive inks to react on the orifice plate, as the precipitates would be difficult to later remove. Also, following the wiping, the pen spits to eject any blended fluid from the nozzles prior to recapping.

Figure 5:
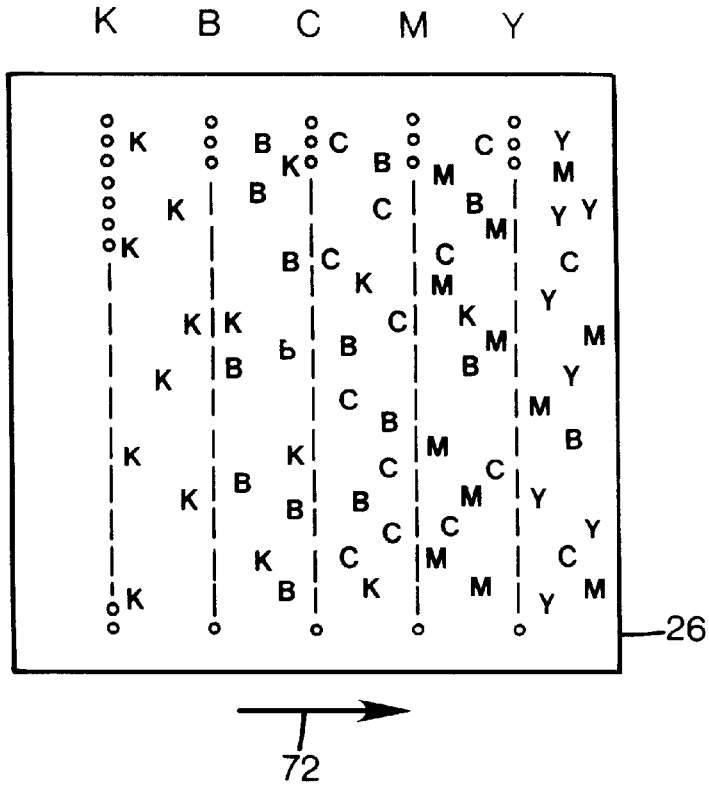
FIGS. 5 and 6 are plan views of the ink jet print head of FIG. 2 after wiping in different directions.

FIG. 5 reflects the wiping direction of the preferred embodiment system, in which the wiper blade edge is parallel to the nozzle columns, and the pen moves in a direction perpendicular to the blade edge. For discussion purposes, the illustration is made as if the print head 26 is fixed, and the wiper is drawn left-to-right across the print head in a wiping direction 72. The figure illustrates the presence of the different fluids in the film formed during wiping by the symbolic column letters associated with each fluid. Between columns K and B, only black ink is distributed. Between columns B and C, a mixture of black ink and the buffer is formed. No unbuffered black ink reaches any of the color columns, or mixes with color ink in the absence of the buffer in the mixture. Before any black ink reaches the color ink, it is chemically reacted with the buffer to form a mixture that does not undesirably react with the color ink. As wiping proceeds, the color inks are mixed into the film, with presence of the buffer or other suitable chemical preventing any reactions on the orifice plate. When wiping proceeds in the opposite direction, a similar result occurs, with a film including only the compatible color inks to the right of the buffer column, with a mixture of color inks and buffer to the left of the buffer column, and black introduced to mix with color ink to the left of the black column only in the presence of the buffer in the mixture.

Figure 6:
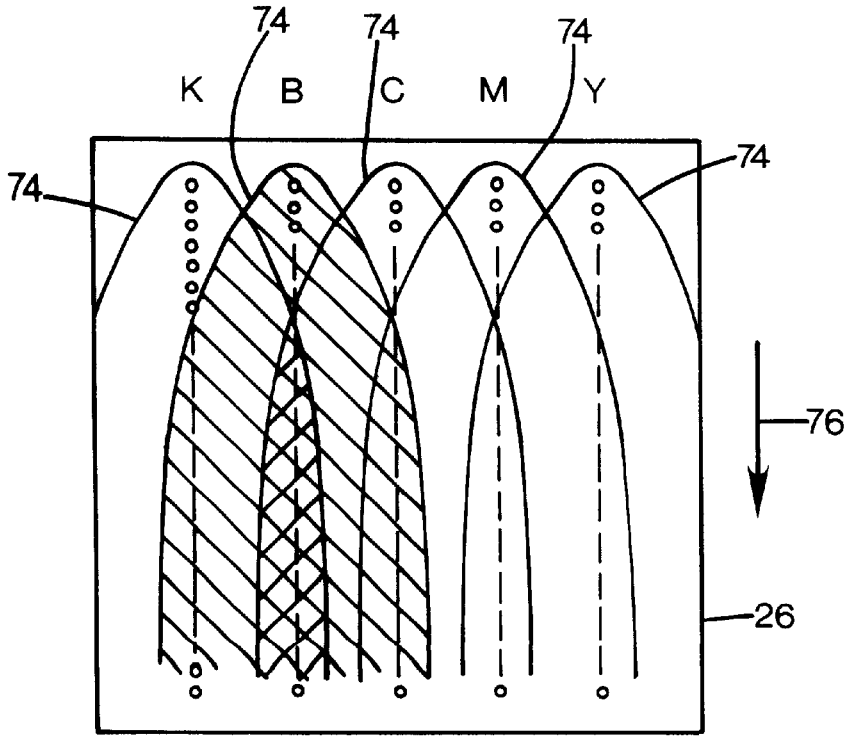

FIG. 6 shows an alternative wiping approach, in which a movable wiper having a blade perpendicular to the nozzles columns and parallel to the pen's axis of reciprocation is used to wipe in direction 76 relative to the print head. Such a wiper may be used to wipe a stationary pen at the service station. With this method, the wiper does not carry ink from one column to the next, but largely carries each ink type along its own nozzle column. However, as ink builds up in front of the wiper blade, it spreads along the blade, where it meets the ink from adjacent columns. This spreading appears as a wake 74 associated with each column. Because the wakes spread to meet the wakes from adjacent columns, mixtures of fluids from adjacent columns are formed. In the absence of the buffer column, the black and cyan inks from columns K and C would meet to react and deposit an unwanted precipitate on the print head. However, with the reactive inks segregated on opposite sides of the buffer column, the spreading inks first encounter the buffer solution before encountering each other. Thus any intermixing of the different ink types occurs only in the presence the buffer solution.

While the above is discussed in terms of preferred and alternative embodiments, the invention is not intended to be so limited. For instance, while buffer solution is discussed as preventing the effects of unwanted ink reactions on the orifice plate, a wide variety of solutions may be used. With other ink chemistries, any fluid might be dispensed in the disclosed manner from a column of nozzles, regardless of whether the fluid prevents a reaction, causes a reaction when the lack of a reaction is undesirable, or causes a desirable or unproblematic reaction instead of an undesirable reaction. Also, the fluid so dispensed need not chemically react with the inks, but may provide a beneficial effect by serving as a barrier, lubricant, solvent, or any other functional fluid function. By drawing any fluid from nozzles formed as a normal part on ink jet component manufacturing, the additional complexities of employing other means to apply the fluid to the print head are avoided. The use of the term "buffer" is intended to broadly encompass any beneficial non-printing fluid, pigmented or otherwise, regardless of whether it in fact is chemically capable of a buffering reaction or function.

What is claimed is:

1. An ink jet print cartridge comprising:

a body defining a first ink chamber containing a first supply of a first ink;

the body defining a second ink chamber containing a second supply of a second ink, the second ink chemically reactive with the first ink;

the body defining a third fluid chamber containing an unpigmented fluid;

a printhead attached to the body and defining a first set of orifices connected to the first ink chamber, a second set of orifices connected to the second ink chamber, and a third set of orifices connected to the third fluid chamber;

the third set of orifices interposed between the first and second sets of orifices.

2. The cartridge of claim 1 wherein the first and second inks have different acidity levels, and wherein the unpigmented fluid is a buffer.

3. The cartridge of claim 1 wherein the first and second inks are of different colors.

4. The cartridge of claim 1 wherein the cartridge includes a third and fourth ink supply, wherein the first ink is black, the second, third and fourth inks are of different colors, and wherein the black ink is reactive with respect to each of the second, third and fourth ink to generate a chemical reaction resulting in a precipitate, and wherein the unpigmented fluid prevents the chemical reaction.

* * * * *